US010338618B2

(12) United States Patent
Mayer et al.

(10) Patent No.: US 10,338,618 B2
(45) Date of Patent: Jul. 2, 2019

(54) LOW DROPOUT REGULATOR CIRCUIT AND METHOD FOR CONTROLLING A VOLTAGE OF A LOW DROPOUT REGULATOR CIRCUIT

(71) Applicant: ams AG, Unterpremstaetten (AT)

(72) Inventors: Martin Mayer, Baernbach (AT); Thomas Jessenig, Attendorf (AT)

(73) Assignee: ams AG, Unterpremstaetten (AT)

( * ) Notice: Subject to any disclaimer, the term of this patent is extended or adjusted under 35 U.S.C. 154(b) by 0 days.

(21) Appl. No.: 15/546,656

(22) PCT Filed: Jan. 21, 2016

(86) PCT No.: PCT/EP2016/051239
§ 371 (c)(1),
(2) Date: Jul. 26, 2017

(87) PCT Pub. No.: WO2016/120150
PCT Pub. Date: Aug. 4, 2016

(65) Prior Publication Data

US 2018/0017984 A1 Jan. 18, 2018

(30) Foreign Application Priority Data

Jan. 28, 2015 (EP) ..... 15152915

(51) Int. Cl.
*G05F 1/575* (2006.01)

(52) U.S. Cl.
CPC ..... *G05F 1/575* (2013.01)

(58) Field of Classification Search
CPC ..... G05F 1/575; G05F 1/562; G05F 1/563
See application file for complete search history.

(56) References Cited

U.S. PATENT DOCUMENTS 7,710,090 B1 * 5/2010 Kimura ..... G05F 1/5735 323/276
2001/0030530 A1 * 10/2001 Marty ..... G05F 1/565 323/280
2006/0164053 A1 * 7/2006 Walter ..... G05F 1/575 323/282
2008/0174289 A1 * 7/2008 Gurcan ..... G05F 1/575 323/280

(Continued)

FOREIGN PATENT DOCUMENTS

EP 1635239 A1 3/2006

*Primary Examiner* — Harry R Behm
(74) *Attorney, Agent, or Firm* — Fish & Richardson P.C.

(57) ABSTRACT

An LDO circuit comprises a pass element, and input stage, a current sink, a comparator and a control circuit. The pass element is configured to generate an output voltage depending on a gate signal and on an input voltage. The input stage is configured to generate a steering signal based on a deviation between a first reference signal and a feedback signal, the feedback signal being based on the output voltage. The current sink is controlled by a steering signal and connected between the gate control terminal and a reference terminal. The comparator is configured to compare the steering signal to a second reference signal and to generate a switch signal based on the comparison. The control circuit comprises a first current path and is configured to suspend, in particular temporarily suspend, the first current path depending on the switch signal.

31 Claims, 3 Drawing Sheets

(56) References Cited

U.S. PATENT DOCUMENTS

| | | | | |
|---|---|---|---|---|
| 2009/0322295 | A1 | 12/2009 | Scoones et al. | |
| 2010/0289472 | A1 | 11/2010 | Renous | |
| 2011/0181257 | A1* | 7/2011 | Pancholi | G05F 1/575 323/280 |
| 2013/0113447 | A1 | 5/2013 | Kadanka | |
| 2015/0346749 | A1* | 12/2015 | Bernardon | G05F 1/575 323/274 |

* cited by examiner

LOW DROPOUT REGULATOR CIRCUIT AND METHOD FOR CONTROLLING A VOLTAGE OF A LOW DROPOUT REGULATOR CIRCUIT

BACKGROUND OF THE INVENTION

The present disclosure relates to a low dropout regulator, LDO, circuit and to a method for controlling a voltage, in particular an output voltage, of an LDO circuit.

Here and hereafter, the terminology "LDO circuit" comprises all types of low dropout regulator circuits and also charger blocks that are implemented as low dropout regulator circuits.

LDO circuits are building blocks that are widely used for example in power management solutions. For example modern battery powered applications may require a power management which is optimized in view of quiescent current and in performance at the same time. Conventional LDO circuits may suffer from the fact that good transient load performance and low quiescent current of the LDO circuit are hard to achieve at the same time.

Existing LDO circuits may accept high quiescent current consumption. Other existing concepts may be difficult to stabilize and cause an additional current consumption, which may be a disadvantage in overall low quiescent devices. Furthermore, existing concepts may cause offset problems increasing quiescent current in some parameter ranges.

SUMMARY OF THE INVENTION

The present disclosure provides an improved concept for low dropout regulation allowing for a reduced quiescent current of an LDO circuit, while maintaining a good performance.

According to the improved concept, a control circuit of an LDO circuit serves for achieving a good transient load performance. Certain branches of the control circuit are suspended for certain values of an input voltage. In particular, the branches are suspended during a dropout mode of operation of the LDO circuit, while they are activated or not suspended, respectively, during other modes of operation. To this end, circuitry is used to compare an output of an input stage with a second reference voltage. Consequently, a quiescent current of the LDO circuit may be reduced by means of the improved concept, while the overall performance is not significantly affected.

According to the improved concept, an LDO circuit comprises a pass element, and input stage, a current sink, a comparator and a control circuit. The pass element is configured to generate an output voltage at an output terminal depending on a gate signal and on an input voltage. The gate signal is received at a gate control terminal and the input voltage is received at an input terminal. The input stage is configured to generate a steering signal based on a deviation between a first reference signal and a feedback signal, the feedback signal being based on the output voltage. The current sink is controlled by a steering signal and connected between the gate control terminal and a reference terminal, for example a ground terminal. The comparator is configured to compare the steering signal to a second reference signal and to generate a switch signal based on the comparison.

The control circuit comprises a first current path, which is coupled between the input terminal and the gate control terminal. The control circuit is configured to suspend, in particular temporarily suspend, the first current path depending on the switch signal. In particular, the control circuit is configured to suspend first current path for certain values of the switch signal and not to suspend and/or to activate the first current path for certain other value soft switch signal.

In several implementations of the LDO circuit, the switch signal assumes a first switch value if a value of the second reference signal is smaller than a value of the steering signal and the switch signal assumes a second switch value if the value of the second reference signal is larger than the value of the steering signal. In such implementations, the control circuit is configured to suspend the first current path if the switch signal assumes the first switch value and not to suspend and/or to activate the first current path if the switch signal assumes the second switch value or vice versa.

Herein, to suspend the first current path means to disconnect, effectively disconnect, switch off or decouple one or more components comprised by the first current path in the sense that only a reduced current, essentially no current or no current can flow between the input terminal and the current sink via the first current path, if the latter is suspended. To activate the first current path means to reconnect, effectively reconnect, switch on or couple the one or more components. To this end, in several implementations of the LDO circuit, the first current path comprises a switching element, such as a switch, a transistor, a field effect transistor or the like. The switching element is then controlled by the switch signal for suspending and/or activating the first current path.

In several implementations of the LDO circuit, the pass element features a resistance or an effective resistance with respect to an electrical current between the input terminal and the output terminal. The resistance or effective resistance of the pass element depends on the gate signal, which corresponds for example a gate voltage. Since the gate signal effectively depends on the output voltage, the output voltage may be controlled by the LDO circuit. Therein, a value of the first reference signal is derived from a value of a target output voltage. The feedback signal is derived from the output voltage in a fashion corresponding to the relation of the first reference signal to the target output voltage.

In some implementations of the LDO circuit, the current sink determines a current through the control circuit. In particular, depending on the steering signal, the current sink may affect an amount of current flowing between the input terminal and a reference terminal, for example a ground terminal. In this way, also the gate signal is affected by the steering signal via the current sink and consequently the gate signal is affected by the feedback signal and the output voltage. In this way, the output voltage is controlled, for example controlled to the target output voltage.

The control circuit is arranged and configured to stabilize the operation of the LDO circuit, in particular to compensate fluctuations for example in the input voltage or due to a load connected to the output terminal. To this end, in several implementations of the LDO circuit, the first current path comprises for example a first resistive element and/or a first current source. The first resistive element and the first current source may be linear or non-linear elements or devices. This leads for example to a fast transient performance of the LDO circuit.

Due to the temporary suspension of the first current path, a quiescent current of the LDO circuit may be reduced, while the overall performance is not significantly affected.

In several implementations, the LDO circuit is configured to operate in a dropout mode of operation and in a regulation mode of operation. The control circuit is configured to suspend the first current path when the LDO circuit is operating in the dropout mode.

According to some implementations, the control circuit is configured to not suspend and/or to activate the first current path when the LDO circuit is operating in the regulation mode.

The LDO circuit is for example operating in the dropout mode if the input voltage is smaller than a threshold input voltage. Therein, the threshold input voltage corresponds for example to a sum of a target output voltage and a dropout voltage. The dropout voltage may for example be given by a minimum voltage drop between the input terminal and the output terminal via the pass element.

The LDO circuit is for example operating in the regulation mode if the input voltage is larger than the threshold input voltage.

In several implementations, the LDO circuit is configured to operate in a dropout mode of operation and in a regulation mode of operation depending on a relation between the steering signal and the second reference signal. In such implementations, the control circuit is configured to suspend the first current path when the LDO circuit is operating in the dropout mode and not to suspend or to activate the first current path when the LDO circuit is operating in the regulation mode. In particular, the control circuit is configured to activate the first current path if the first current path is suspended when the LDO circuit enters the regulation mode.

In some implementations of the LDO circuit, the LDO circuit operates in the dropout mode if a value of the steering signal is larger than a value of the second reference signal. In such implementations, the LDO circuit operates in the regulation mode of operation if the value of the steering signal is smaller than the value of the second reference signal. The comparator is configured to generate the switch signal accordingly.

In other implementations of the LDO circuit, the LDO circuit operates in the dropout mode if a value of the steering signal is smaller than a value of the second reference signal. In such implementations, the LDO circuit operates in the regulation mode of operation if the value of the steering signal is larger than the value of the second reference signal. The comparator is configured to generate the switch signal accordingly.

In some implementations of the LDO circuit, the LDO circuit operates in the dropout mode if a value of a signal depending on the steering signal is larger than a value of the second reference signal. In such implementations, the LDO circuit operates in the regulation mode of operation if the value of the signal depending on the steering signal is smaller than the value of the second reference signal.

In other implementations of the LDO circuit, the LDO circuit operates in the dropout mode if a value of the signal depending on the steering signal is smaller than a value of the second reference signal. In such implementations, the LDO circuit operates in the regulation mode of operation if the value of the signal depending on the steering signal is larger than the value of the second reference signal.

As a consequence of the configuration and arrangement of the LDO circuit, the output voltage is for example controlled to the target output voltage if the input voltage is larger than a threshold input voltage. The threshold input voltage may for example correspond to a sum of the target output voltage and a dropout voltage. Therein, the dropout voltage is for example given by a minimum voltage drop between the input terminal and the output terminal via the pass element. The regulation mode of operation may for example correspond to such a case, namely the input voltage being larger than the threshold input voltage.

In case the input voltage is smaller than the threshold input voltage, the LDO circuit does for example not control the output voltage to the target output voltage. In such a case, the output voltage is for example related to the input voltage in a linear fashion, in particular the output voltage may be equal to the input voltage up to the dropout voltage. The dropout mode of operation may for example correspond to such a case, namely the input voltage being smaller than the threshold input voltage.

In several implementations of the LDO circuit, the control circuit comprises a second current path coupled in parallel to the first current path. The second current path comprises for example a second resistive element and/or a second current source. In this way, the stabilization of the LDO circuit may be improved. The second resistive element and the second current source may be linear or non-linear elements or devices.

In some implementations, wherein the control circuit is configured to temporarily suspend the first and the second current path, the first current path comprises a first resistive element and the second current path comprises a second current source.

In further implementations of the LDO circuit, the control circuit is configured to suspend the second current path depending on the switch signal. In particular, the control circuit may be configured to suspend the second current path if and only if the first current path is suspended. That means that, in particular, the control circuit may be configured to suspend the second current path when the LDO circuit is operating in the dropout mode. Correspondingly, the control circuit is configured to activate the second current path when the first current path is activated, in particular when the LDO circuit is operating in the regulation mode. In such implementations, the reduction of the quiescent current may be further improved by the temporary suspension of the second current path.

In alternative implementations, the second current path is not suspended when the LDO circuit is operating in the dropout mode. In such implementations, the second current path is for example always activated. Consequently, the stabilization of the operation of the LDO circuit may be further improved.

In further implementations, the control circuit comprises further current paths coupled in parallel to the first and the second current path. The further current paths may for example comprise further resistive elements and/or further current sources for a further improvement of the stabilization of the LDO circuit. The further resistive elements and the further current sources may be linear or non-linear elements or devices.

In some implementations some or all of the further current paths are temporarily suspended, in particular are suspended when the first current path is suspended, in particular when the LDO circuit is operating in the dropout mode. In other implementations, the further current paths are not suspended when the first current path is suspended, in particular when the LDO circuit is operating in the dropout mode.

In some implementations, some of the further current paths are temporarily suspended, in particular are suspended when the first current path is suspended, in particular when the LDO circuit is operating in the dropout mode and some of the further current paths are not suspended when the first current path is suspended, in particular when the LDO circuit is operating in the dropout mode.

The further current paths lead for example to a further improvement of the stabilization of the operation of the LDO circuit. The temporary suspension of some or all of the further current paths may lead to a further reduction of the quiescent current.

In several implementations of the LDO circuit, the input stage comprises an operational amplifier with a first amplifier input coupled to the output terminal for receiving the first reference signal and with a second amplifier input for receiving the feedback signal. The operational amplifier also comprises an amplifier output for supplying the steering signal.

In such implementations, the LDO circuit comprises for example a compensation circuit coupled between the operational amplifier and the current sink. The compensation circuit may for example comprise capacitive elements and/or resistive elements. In some implementations, the compensation circuit comprises a capacitor coupled between the amplifier output and a reference terminal, for example a ground terminal. In further implementations the compensation circuit comprises an RC- or a CRC-element or a similar element coupled between the amplifier output and the reference terminal.

In several implementations of the LDO circuit, the operational amplifier is implemented as an operational transconductance amplifier.

In some implementations, the LDO circuit further comprises a feedback generating circuit, such as a voltage divider, coupled between the first amplifier input and the output terminal. The feedback generating circuit is arranged and configured to generate the feedback signal based on the output voltage. In such implementations, the value of the first reference signal is derived from the value of the target output voltage correspondingly. In particular, a ratio of an absolute value of the feedback signal and an absolute value of the output voltage may be equal to a ratio of an absolute value of the first reference signal and an absolute value of the target output voltage.

According to several implementations of the LDO circuit, the second reference signal corresponds to a voltage that, if applied to a control terminal of the current sink, would cause a conducting state of the current sink, in particular would cause a minimum resistance of the current sink.

According to some implementations of the LDO circuit, the current sink is in a conducting state, for example has a minimum resistance, if a value of the steering signal or a value of the signal depending on the steering signal is equal to a value of the second reference signal.

In several implementations of the LDO circuit, a value of the second reference signal depends on a characteristic value of the current sink.

In some implementations of the LDO circuit, the current sink is implemented as a field effect transistor. The current sink may for example be implemented as a metal oxide semiconductor, MOS, transistor, for example as an n-channel MOS, NMOS or a p-channel MOS, PMOS, transistor. The value of the second reference signal corresponds to a voltage being larger than a threshold voltage, in particular a threshold gate voltage, of the current sink, in particular of the field effect transistor.

In such implementations, a source terminal or a drain terminal of the current sink is coupled to the gate control terminal. A gate terminal of the current sink is coupled to the amplifier output. The second reference signal then corresponds to a voltage that, if applied to the gate terminal of the current sink, would cause a minimum source-drain resistance of the current sink.

In several implementations of the LDO circuit, the pass element is implemented as a field effect transistor, for example as a MOS, a NMOS or a PMOS transistor. In particular, in implementations wherein the current sink is implemented as an N-channel transistor, the pass element may be implemented as a P-channel transistor and vice versa.

In further implementations, the LDO circuit further comprises a mirror device arranged and configured to adjust a current through the first current path depending on the output voltage.

According to the improved concept, also a method for controlling an output voltage of an LDO circuit is provided. The method comprises applying an input voltage to an input terminal of a pass element of the LDO and a gate signal to a gate control terminal. The method further comprises generating the output voltage depending on the gate signal and on the input voltage and generating a steering signal based on a deviation between a first reference signal and a feedback signal, wherein the feedback signal is based on the output voltage. The method further comprises comparing the steering signal to a second reference signal and generating a switch signal based on the comparison. Furthermore, the method comprises temporarily suspending a first current path of the LDO circuit depending on the switch signal.

In further implementations of the method the LDO circuit is configured to operate in a dropout mode of operation and the LDO circuit is configured to operate in a regulation mode of operation. The method comprises operating the LDO circuit in the dropout mode or in the regulation mode depending on a relation between the steering signal and the second reference signal. The method further comprises suspending the first current path when the LDO is operating in the dropout mode and not suspending or activating the first current path when the LDO circuit is operating in the regulation mode.

Further implementations of the method are derived readily from the several implementations and embodiments of the LDO circuit and vice versa.

In the following, the invention is explained in detail with the aid of exemplary implementations by reference to the drawings. Components that are functionally identical or have an identical effect may be denoted by identical references. Identical components and/or components with identical effects may be described only with respect to the Figure where they occur first; their description is not necessarily repeated in subsequent Figures.

DETAILED DESCRIPTION

Figure 1:
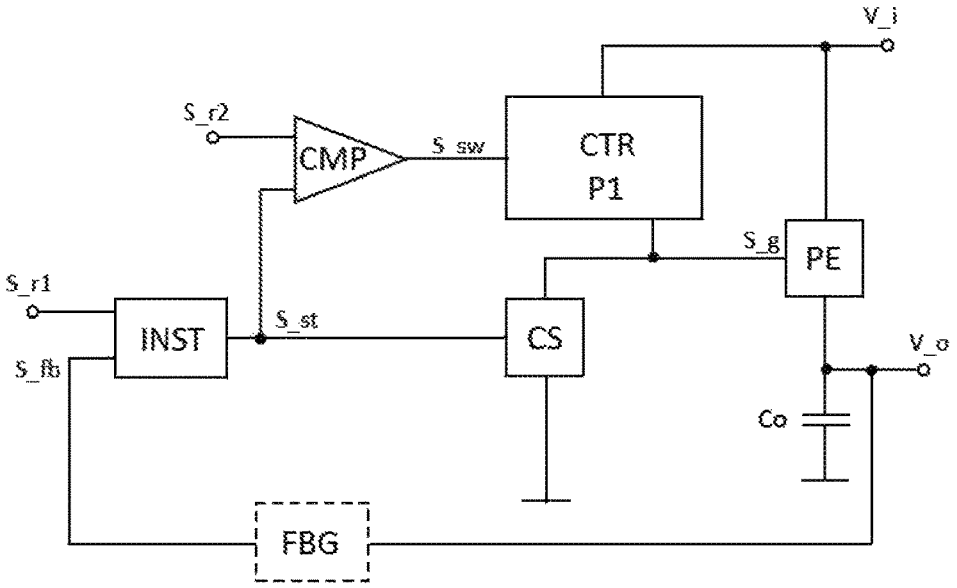
FIG. 1 shows an exemplary implementation of an LDO circuit according to the improved concept.

FIG. 1 shows an exemplary implementation of a low dropout regulator, LDO, circuit according to the improved concept. The LDO circuit comprises a pass element PE, an input stage INST, a current sink CS, a comparator CMP and a control circuit CTR, the control circuit CTR comprising a first current path P1. Optionally, the LDO circuit further comprises a feedback generating circuit FBG, for example a voltage divider, and an output capacitor Co.

The pass element PE receives an input voltage V_i at an input terminal and a gate signal S_g at a gate control terminal and supplies an output voltage V_o at an output terminal. The output capacitor Co is coupled between the output terminal and a ground terminal. The current sink CS is coupled between the gate control terminal and a ground terminal and is further connected to an output of the input stage INST. The input stage INST receives a first reference signal S_r1 and a feedback signal S_fb. A value of the first reference signal S_r1 is for example derived from a target output voltage. The feedback signal S_fb is based on the output voltage V_o, for example is equal to the output voltage V_o, or, in implementations comprising feedback generating circuit FBG, is generated by the feedback generating circuit FBG based on the output voltage V_o.

A at a first comparator input of the comparator CMP, a second reference signal S_r2 is received and a second comparator input of the comparator CMP is connected to the output of the input stage INST. A comparator output of the comparator CMP is connected to the control circuit CTR. The control circuit CTR and the first current path P1 are furthermore coupled between the input terminal and the gate control terminal.

The pass element PE generates the output voltage V_o depending on the gate signal S_g and the input voltage V_i. Therein, the gate signal S_g for example controls a resistance of the pass element PE and consequently a voltage drop between the input terminal and the output terminal.

The output voltage V_o is fed back to the input stage INST either directly or via the optional feedback generating circuit FBG, resulting in the feedback signal S_fb. The input stage INST generates the steering signal S_st based on a deviation between the first reference signal S_r1 and the feedback signal S_fb. In turn, the steering signal S_st controls the current sink CS, for example by controlling a resistance of the current sink CS and consequently a value of a current between the input terminal and the ground terminal via the control circuit CTR, for example via the first current path P1.

The control circuit CTR and in particular the first current path P1 are configured and arranged to stabilize the operation of the LDO circuit, in particular to compensate fluctuations for example in the input voltage V_i or in a load connected to the output terminal. For example poles, in particular parasitic poles, resulting from characteristics of the input stage INST may be stabilized by the control circuit CTR and the first current path P1. To this end, the first current path P1 may for example comprise a first resistive element R1 and/or a first current source I1.

The comparator CMP compares the steering signal S_st to the second reference signal S_r2 and generates the switch signal S_sw based on the comparison. The switch signal S_sw is provided to the control circuit CTR. The control circuit CTR is configured to temporarily suspend the first current path P1 depending on the switch signal S_sw. Due to the temporary suspension of the first current path P1, a quiescent current of the LDO circuit may be reduced.

Figure 2:
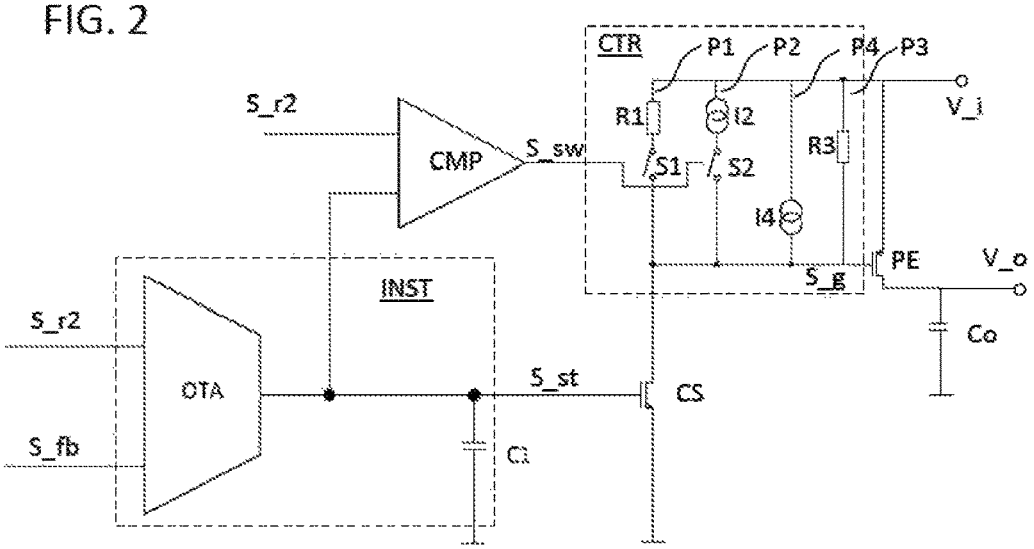
FIG. 2 shows another exemplary implementation of an LDO circuit according to the improved concept.

FIG. 2 shows another exemplary implementation of an LDO circuit according to the improved concept, based on the implementation shown in FIG. 1.

In the implementation of FIG. 2, the pass element PE is implemented as a PMOS transistor with a source terminal connected to the input terminal and with a drain terminal connected to the output terminal. The current sink CS is implemented as an NMOS transistor with a drain terminal connected to the gate control terminal and with a source terminal connected to a ground terminal. The current sink CS has a gate terminal at which the steering signal S_st is received from the input stage INST. In alternative implementations, the pass element PE may for example be implemented as an NMOS transistor, while the current sink CS is implemented as a PMOS transistor.

The input stage INST comprises an operational transconductance amplifier OTA with an amplifier output, a first amplifier input and a second amplifier input. The amplifier output is connected to the gate terminal of the current sink CS. The operational transconductance amplifier OTA receives the first reference signal S_r1 at the first amplifier input and the feedback signal fb at the second amplifier input. The coupling of the second amplifier input to the output terminal is not shown in FIG. 2, but is implemented as shown in FIG. 1 for example via a direct connection or via the feedback generating circuit FBG generating the feedback signal S_fb based on the output voltage V_o. The input stage INST further comprises an input capacitor C1 coupled between the amplifier output and a ground terminal. The input capacitor C1 acts as a compensation circuit. In alternative implementations the compensation circuit may also be implemented differently, for example as an RC-element or a CRC-element.

In the implementation of FIG. 2, the control circuit CTR comprises a first, a second, a third and a fourth current path P1, P2, P3, P4 that are connected in parallel to each other. The first current P1 path comprises a first resistive element R1 and a first switch S1 connected in series. The second current path P2 comprises a second current source I2 and a second switch S2 connected in series. The third current path P3 comprises a third resistive element R3 and the fourth current path P4 comprises a fourth current source 14. The control circuit CTR is coupled to the comparator CMP via the first and the second switch S1, S2. The first and the second switch S1, S2 are controlled by means of the switch signal S_sw. Furthermore, the current paths P1, P2, P3, P4 are coupled between the input terminal and the gate control terminal.

A source-drain resistance of the pass element PE depends on the gate signal S_g. Therefore, the gate signal S_g controls a voltage drop between the input terminal and the output terminal, in particular a voltage difference between the input voltage V_i and the output voltage V_o.

The output voltage V_o is fed back to the second amplifier input either directly or via the optional feedback generating circuit FBG, resulting in the feedback signal S_fb. The operational transconductance amplifier OTA generates the steering signal S_st based on a deviation between the first reference signal S_r1 and the feedback signal S_fb. In particular, the operational transconductance amplifier OTA generates a current that depends on a difference between the first reference signal S_r1 and the feedback signal S_fb. The generated current charges the input capacitor C1, which results in a gate voltage at the gate terminal of the current sink CS.

Consequently, the steering signal S_st effectively controls the gate voltage at the gate terminal of the current sink CS the current sink CS and therefore a source-drain resistance of the current sink CS. In this way a current in the control circuit CTR is controlled, in particular a current between the input terminal and the ground terminal via the control circuit CTR, in particular via the current paths P1, P2, P3, P4. In this way, effectively the gate signal S_g and, as a consequence, the output voltage V_o, may be controlled.

The comparator CMP compares the steering signal S_st to the second reference signal S_r2 and generates the switch signal S_sw based on the comparison. Depending on the switch signal S_sw, the first and the second switch S1, S2 are either opened or closed. Therein, a value of the second reference signal S_r2 is larger than a characteristic value of the current sink CS, in particular larger than a threshold voltage of the current sink CS.

Consequently, if a value of the steering signal S_st is larger than a value of the second reference signal S_r2, this means that the source-drain resistance of the current sink CS is at its minimum. In a sense, the current sink CS then acts as a closed switch. In this case the switch signal S_sw is generated such that the first and the second switch S1, S2 are opened, suspending the first and the second current path P1, P2.

If the source-drain resistance of the current sink CS is at its minimum, also the source-drain resistance of the pass element PE is at its minimum and the voltage difference between the input voltage V_i and the output voltage V_o is at its minimum, that is the dropout voltage. In a sense, the pass element PE then acts as a closed switch. In this case, the LDO circuit is operating in a dropout mode of operation, that is the output voltage V_o is not controlled to the target output voltage, but follows the input voltage V_i linearly up to the dropout voltage.

On the other hand, if the value of the steering signal S_st is smaller than the value of the second reference signal S_r2, that means the source-drain resistance of the current sink CS is larger than its minimum. In this case, the switch signal S_sw is generated such that the first and the second switch S1, S2 are closed, activating or not suspending, respectively, the first and the second current path P1, P2.

If the source-drain resistance of the current sink CS is larger than its minimum, also the source-drain resistance of the pass element PE is larger than its minimum and the voltage difference between the input voltage V_i and the output voltage V_o is larger than the dropout voltage. In this case, the LDO circuit is operating in a regulation mode of operation, that is the output voltage V_o is controlled to the target output voltage.

During the regulation mode of operation, the current paths P1, P2, P3, P4 stabilize the operation of the LDO. In particular, the current paths P1, P2, P3, P4 generate for example an impedance and an additional current within the control circuit CTR due to the resistive elements R1, R3 and the current sources I2, I4.

During the dropout mode of operation, an activation of the first and the second current path P1, P2 would lead to an increased quiescent current. However, in the implementation shown in FIG. 2, the first and the second current path P1 P2 are suspended during the dropout mode. In this way, a quiescent current of the LDO circuit may be reduced, while an overall performance of the LDO circuit, in particular during the regulation mode of operation, is not or not significantly affected.

It is pointed out that the number of the current paths P1, P2, P3, P4 being equal to four is not necessarily given for alternative implementations. In particular, implementations with less or more current paths, for example one, two, three or more than four current paths can be realized according to the improved concept. A common feature is that the control circuit is configured to temporarily suspend at least one current path, for example the first current path P1. Also implementations wherein the first current path is not suspended by the control circuit but by another component of the LDO circuit may be realized according to the improved concept.

Figure 3:
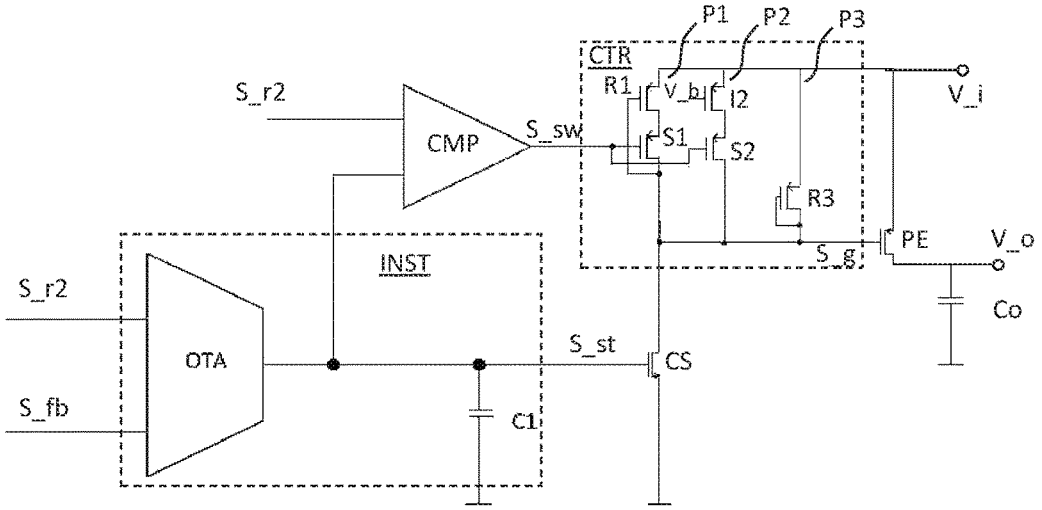
FIG. 3 shows another exemplary implementation of an LDO circuit according to the improved concept.

FIG. 3 shows another exemplary implementation of an LDO circuit according to the improved concept, based on the implementation of FIG. 2.

In contrast implementation of FIG. 2, the control circuit CTR of FIG. 3 comprises only the first, the second and the third current path P1, P2, P3, but not the fourth current path P4. Furthermore, the first and the second switch S1, S2 are implemented as PMOS transistors with respective gate terminals that are connected to the comparator output for receiving the switch signal S_sw.

The first and the third resistive element R1, R3 as well as the second current source I2 are also implemented as PMOS transistors. Therein, a source terminal of the third resistive element R3 is connected to the input terminal and a drain terminal of the third resistive element R3 is connected to the gate control terminal. A gate terminal of the third resistive element R3 is connected to the drain terminal of the third resistive element R3.

A source terminal of the first resistive element R1 is connected to the input terminal and a drain terminal of the first resistive element R1 is connected to a source terminal of the first switch S1. A drain terminal of the first switch S1 is connected to a gate terminal of the first resistive element R1 and to the gate control terminal. A source terminal of the second current source I2 is connected to the input terminal and a drain terminal of the second current source I2 is connected to a source terminal of the second switch S2. A gate terminal of the second current source I2 is supplied with a bias voltage V_b. The bias voltage V_b is for example kept constant at a defined value.

Figure 4:
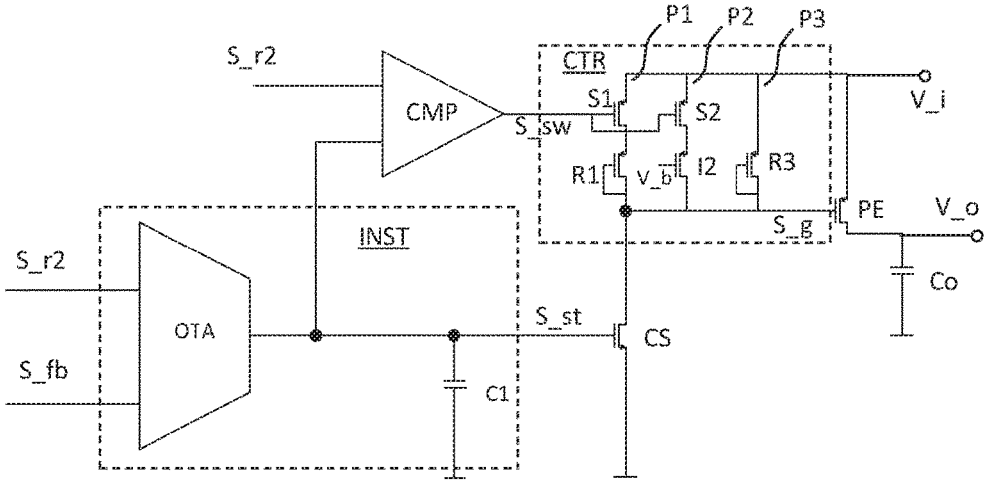
FIG. 4 shows another exemplary implementation of an LDO circuit according to the improved concept.

FIG. 4 shows another exemplary implementation of an LDO circuit according to the improved concept, based on the implementation of FIG. 3.

In the implementation of FIG. 4, an arrangement of the first switch S1 with respect to the first resistive element R2 as well as an arrangement of the second current source I2 with respect to the second switch S2 are different from the implementation of FIG. 3.

The source terminal of the first switch S1 is connected to the input terminal and the drain terminal of the first switch S1 is connected to the source terminal of the first resistive element R1. The drain terminal of the first resistive element R1 is connected to the gate terminal of the first resistive element R1 and to the gate control terminal. The source terminal of the second switch S2 is connected to the input terminal and the drain terminal of the second switch S2 is connected to the source terminal of the second current source I2. The drain terminal of the second current source is connected to the gate control terminal.

The function of the LDO circuit of FIG. 4 is identical or essentially identically to the function of the LDO circuit of FIG. 3.

Figure 5:
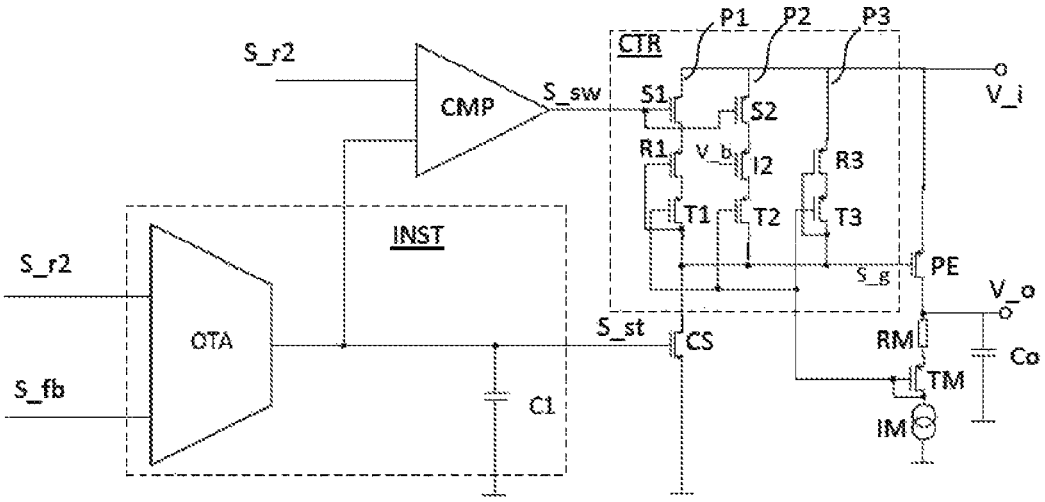
FIG. 5 shows another exemplary implementation of an LDO circuit according to the improved concept.

FIG. 5 shows another exemplary implementation of an LDO circuit according to the improved concept, based on the implementation of FIG. 4.

Compared to the implementation shown in FIG. 4, in FIG. 5 the LDO circuit further comprises a mirror resistive element RM, a mirror transistor TM and a mirror current source IM that are connected in series with each other and are connected between the output terminal and a ground terminal. The mirror transistor TM is implemented as a PMOS transistor. A gate terminal of the mirror transistor TM is connected to a source terminal of the mirror transistor TM, which is connected to the mirror current source IM.

Furthermore, the control circuit CTR comprises a first regulation transistor T1 with a source terminal connected to the drain terminal of the first resistive element R1, a second regulation transistor T2 with a source terminal connected to the drain terminal of the second current source I2 and a third regulation transistor T3 with a source terminal connected to the drain terminal of the third resistive element R3. Each of the regulation transistors T1, T2, T3 is implemented as a PMOS transistor and comprises a respective drain terminal connected to the gate control terminal and a respective gate terminal connected to the gate terminal of the mirror transistor TM. In contrast to FIG. 4, the gate terminals of the first and the third resistive element R1, R3 are not connected to the drain terminal of the first and the third resistive element R1, R3, respectively, but to the drain terminal of the first and the third regulation transistor T1, T2, respectively.

The mirror transistor TM implements, in combination with the mirror current source IM and the regulation transistors T1, T2, T3, for example respective floating current mirrors for adjusting a current through the current paths P1, P2, P3 depending on the output voltage V_o. In this way it becomes for example possible to maintain a mirror ratio between the first and the third resistive element R1, R3 upon fluctuations in the input voltage V_i and/or in the output voltage V_o. By means of this arrangement, a quiescent current can be further reduced, for example if the input voltage V_i is close to the threshold input voltage V_ti.

Figure 6:
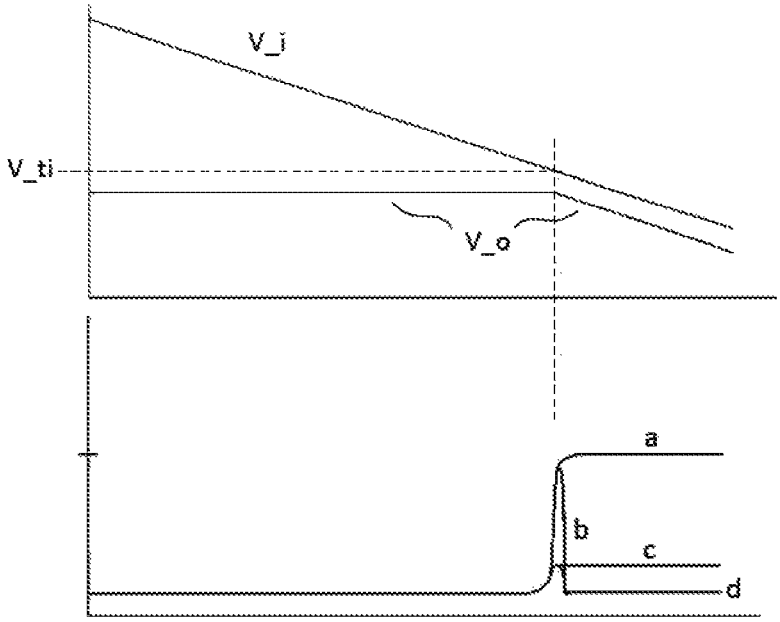
FIG. 6 shows a schematic signal diagram with an input voltage, an output voltage and quiescent current curves for several LDO circuits including LDO circuits according to the improved concept.

FIG. 6 shows a schematic signal diagram with an input voltage V_i, an output voltage V_o and quiescent current curves for several LDO circuits including LDO circuits according to the improved concept.

In the upper part of FIG. 6, a decreasing input voltage V_i is shown. If the input voltage V_i is larger than the threshold input voltage V_ti, the output voltage V_o is regulated to the target output voltage and remains constant in this region. This corresponds to the regulation mode of operation. If the input voltage V_i is smaller than the threshold input voltage V_ti, the output voltage V_o is not regulated to the target output voltage and follows the input voltage V_i in a linear fashion. In particular, in this case the output voltage V_o is equal to the input voltage V_i up to the dropout voltage. This corresponds to the dropout mode of operation.

In the lower part of FIG. 6, the quiescent current is schematically shown for different LDO circuits, corresponding to the curves Iqa, Iqb, Iqc and Iqd. During the regulation mode of operation, that is when the output voltage V_o is controlled to the target output voltage, the quiescent current is generally low for all shown curves Iqa, Iqb, Iqc and Iqd.

Curve Iqa corresponds to an LDO circuit without a temporarily suspended first current path and without the mirror device, that is in particular without the mirror transistor and without the regulating transistors. One can see that the quiescent current increases when the LDO circuit operates in the dropout mode and remains approximately constant during the dropout mode. A value of the quiescent current during the dropout mode is for example significantly higher than a value of the quiescent current during the regulation mode.

Curve Iqb corresponds to an LDO circuit according to the improved concept without the mirror device, that is in particular without the mirror transistor and without the regulating transistors. This includes for example implementations of the LDO circuit as shown in FIGS. 1, 2, 3 and 4. One can see that, apart from an increase in the transition region between regulation mode and dropout mode, in contrast to curve Iqa, the quiescent current is generally low during the dropout mode.

Curve Iqc corresponds to an LDO circuit without a temporarily suspended first current path but with the mirror device, that is in particular with the mirror transistor, the mirror current source, the mirror resistive element and the regulating transistors. Curve Iqc is very similar to curve Iqa, with the difference that an absolute value of the quiescent current during the dropout mode is smaller than for curve Iqa.

Curve Iqd corresponds to an LDO circuit according to the improved concept with the mirror device, that is in particular with the mirror transistor, the mirror current source, the mirror resistive element and the regulating transistors. This includes for example implementations of the LDO circuit as shown in FIG. 5. Curves Iqd is very similar to curve Iqb, with the difference that an absolute value of the quiescent current in the transition region between regulation mode and dropout mode is smaller than for curve Iqb.

In the implementations of the LDO circuit shown in FIGS. 2, 3, 4 and 5, all transistors except the current sink CS are implemented as P-channel transistors, in particular as PMOS transistors. The current sink CS is implemented as an N-channel transistor, in particular as an NMOS transistor. In alternative implementations according to the improved concept, other implementations are possible as well, for example including other types of field effect transistors or bipolar transistors. In particular, implementations wherein all transistors except the current sink CS are implemented as NMOS transistors, while the current sink CS is implemented as a PMOS transistor.

By means of an LDO circuit or a method according the improved concept, the quiescent current of an LDO circuit can be reduced, while at the same time a good performance, in particular a fast transient response, is achieved.

The invention claimed is:

1. A low dropout regulator, LDO, circuit comprising:

a pass element configured to generate at an output terminal an output voltage depending on a gate signal received at a gate control terminal and on an input voltage received at an input terminal;

an input stage configured to generate a steering signal based on a deviation between a first reference signal and a feedback signal, the feedback signal being based on the output voltage;

a current sink continuously controlled by the steering signal and connected between the gate control terminal and a reference terminal;

a comparator configured to compare the steering signal to a second reference signal and to generate a switch signal based on the comparison; and a control circuit comprising a first current path, the first current path coupled between the input terminal and the gate control terminal, the control circuit being configured to temporarily suspend the first current path depending on the switch signal.

2. The LDO circuit according to claim 1, further configured to operate in a dropout mode of operation and wherein the control circuit is configured to suspend the first current path when the LDO circuit is operating in the dropout mode.

3. The LDO circuit according to claim 2, wherein the LDO circuit is operating in the dropout mode if the input voltage is smaller than a threshold input voltage.

4. The LDO circuit according to claim 3, wherein the threshold input voltage corresponds to a sum of a target output voltage and a dropout voltage.

5. The LDO circuit according to claim 4, wherein the dropout voltage is given by a minimum voltage drop between the input terminal and the output terminal via the pass element.

6. The LDO circuit according to claim 2, wherein the output voltage is not controlled to a target value when the LDO circuit is operating in the dropout mode, and the pass element is configured to act as a closed switch.

7. The LDO circuit according to claim 1, further configured to operate in a regulation mode of operation and wherein the control circuit is configured to activate the first current path when the LDO circuit is operating in the regulation mode.

8. The LDO circuit according to claim 7, wherein the LDO circuit is operating in the regulation mode if the input voltage is larger than a threshold input voltage.

9. The LDO circuit according to claim 1, further configured to operate in a dropout mode of operation and in a regulation mode of operation depending on a relation between the steering signal and the second reference signal, wherein the control circuit is configured to suspend the first current path when the LDO circuit is operating in the dropout mode; and to activate the first current path when the LDO circuit is operating in the regulation mode.

10. The LDO circuit according to claim 9, wherein one of the following applies:

the LDO circuit operates in the dropout mode if a value of the steering signal is larger than a value of the second reference signal; or the LDO circuit operates in the dropout mode if the value of the steering signal is smaller than the value of the second reference signal.

11. The LDO circuit according to claim 1, wherein the control circuit comprises a second current path coupled in parallel to the first current path.

12. The LDO circuit according to claim 11, wherein the control circuit is configured to suspend a second current path when the LDO circuit is operating in the dropout mode.

13. The LDO circuit according to claim 11, wherein the second current path is not suspended when the LDO circuit is operating in the dropout mode.

14. The LDO circuit according to claim 1, wherein the input stage comprises an operational amplifier with a first amplifier input for receiving the first reference signal, with a second amplifier input coupled to the output terminal for receiving the feedback signal and with an amplifier output for supplying the steering signal.

15. The LDO circuit according to claim 14, wherein the operational amplifier is implemented as an operational transconductance amplifier.

16. The LDO circuit according to claim 14, further comprising a voltage divider coupled between the second amplifier input and the output terminal.

17. The LDO circuit according to claim 1, wherein the current sink is in a conducting state if a value of the steering signal is equal to a value of the second reference signal.

18. The LDO circuit according to claim 1, wherein a value of the second reference signal depends on a characteristic value of the current sink.

19. The LDO circuit according to claim 1, wherein the current sink is implemented as a field effect transistor; and the value of the second reference signal corresponds to a voltage being larger than a threshold voltage of the current sink.

20. The LDO circuit according to claim 1, wherein the pass element is implemented as a field effect transistor.

21. The LDO circuit according to claim 1, further comprising a mirror device arranged and configured to adjust a current through the first current path depending on the output voltage.

22. The LDO circuit according to claim 1, wherein the steering signal and the switch signal are distinct from each other.

23. The LDO circuit according to claim 1, wherein the gate signal for the pass element is always derived at a connection between the control circuit and the current sink.

24. The LED circuit according to claim 1, wherein the second reference signal is independent of the gate signal.

25. A method for controlling an output voltage of a low dropout regulator, LDO, circuit, wherein the method comprises:

applying an input voltage to an input terminal of a pass element of the LDO circuit and a gate signal to a gate control terminal;

generating the output voltage depending on the gate signal and on the input voltage;

generating a steering signal for continuously controlling an amount of current between the input terminal and a reference terminal using a current sink connected between the gate control terminal and the reference terminal, the steering signal being based on a deviation between a first reference signal and a feedback signal, wherein the feedback signal is derived from the output voltage;

comparing the steering signal to a second reference signal;

generating a switch signal based on the comparison; and suspending a first current path of the LDO circuit depending on the switch signal to operate the LDO circuit in a dropout mode of operation.

26. The method according to claim 25, wherein the first current path is activated when the LDO circuit is operating in a regulation mode of operation.

27. The method according to claim 26, wherein the LDO circuit is operating in the regulation mode if the input voltage is larger than a threshold input voltage.

28. The method according to claim 25, wherein the method further comprises operating the LDO circuit in a dropout mode of operation or in a regulation mode of operation depending on a relation between the steering signal and the second reference signal;

suspending the first current path when the LDO circuit is operating in the dropout mode; and activating the first current path when the LDO circuit is operating in the regulation mode.

29. The method according to claim 25, wherein the LDO circuit is operating in the dropout mode if the input voltage is smaller than a threshold input voltage.

30. The method according to claim 29, wherein the threshold input voltage corresponds to a sum of a target output voltage and a dropout voltage.

31. The method according to claim 30, wherein the dropout voltage is given by a minimum voltage drop via the pass element.

* * * * *